US007554305B2

(12) United States Patent
Nunokawa et al.

(10) Patent No.: US 7,554,305 B2
(45) Date of Patent: Jun. 30, 2009

(54) LINEAR REGULATOR WITH DISCHARGING GATE DRIVER

(75) Inventors: Hideo Nunokawa, Kawasaki (JP); Tatsuo Kato, Kawasaki (JP); Miki Suzuki, Kawasaki (JP); Tomonari Morishita, Kawasaki (JP)

(73) Assignee: Fujitsu Microelectronics Limited, Tokyo (JP)

( * ) Notice: Subject to any disclaimer, the term of this patent is extended or adjusted under 35 U.S.C. 154(b) by 20 days.

(21) Appl. No.: 10/985,905

(22) Filed: Nov. 12, 2004

(65) Prior Publication Data

US 2006/0012354 A1 Jan. 19, 2006

(30) Foreign Application Priority Data

Jul. 13, 2004 (JP) ..... 2004-205912

(51) Int. Cl.
*G05F 1/56* (2006.01)

(52) U.S. Cl. ..... 323/273; 327/109; 363/60

(58) Field of Classification Search ..... 323/273, 323/281, 274, 280; 327/536, 390, 541, 382, 327/388, 109; 363/60
See application file for complete search history.

(56) References Cited

U.S. PATENT DOCUMENTS 5,450,025 A * 9/1995 Shay ..... 326/81
5,545,970 A * 8/1996 Parkes et al. ..... 323/277
5,545,980 A * 8/1996 Nakamoto ..... 324/96
5,548,204 A * 8/1996 Armstrong et al. ..... 323/265
5,689,208 A * 11/1997 Nadd ..... 327/390
5,847,950 A * 12/1998 Bhagwat ..... 363/78
5,923,156 A * 7/1999 Casper ..... 323/273
6,005,378 A * 12/1999 D'Angelo et al. ..... 323/313
6,049,201 A * 4/2000 Feldtkeller ..... 323/288
6,127,882 A * 10/2000 Vargha et al. ..... 327/540
6,150,800 A * 11/2000 Kinoshita et al. ..... 323/280
6,208,124 B1 * 3/2001 Fuchigami et al. ..... 323/281

(Continued)

FOREIGN PATENT DOCUMENTS

DE 10248498 5/2004

(Continued)

OTHER PUBLICATIONS

"Embedded 5 V -to-3.3 V Voltage Regulator for Supplying Digital IC's in 3.3 V CMOS Technology", IEEE Journal of Solid-State Circuits, Gerrit W. den Besten, et al., vol. 33, No. 7, Jul. 1998, pp. 956-962.

(Continued)

*Primary Examiner*—Akm E Ullah
*Assistant Examiner*—Harry Behm
(74) *Attorney, Agent, or Firm*—Arent Fox LLP

(57) ABSTRACT

Even when, for example, electric charge is injected into the output transistor due to external factor such as a noise from the outside, to prevent the step-down voltage from rising, the step-down circuit is comprised of an N channel type output transistor which controls the voltage at the control end, a booster, which is connected to the control end of the output transistor and raises the voltage at the control end and a discharge circuit, which discharges the electric charge at the control end of the output transistor so that the power supply voltage inputted from the input end is stepped down to a desired step-down voltage and outputted from the output end.

6 Claims, 10 Drawing Sheets

U.S. PATENT DOCUMENTS

| | | | | |
|---|---|---|---|---|
| 6,396,334 | B1 * | 5/2002 | Aram | 327/541 |
| 6,442,079 | B2 * | 8/2002 | Lee et al. | 365/189.09 |
| 6,456,155 | B2 * | 9/2002 | Takai | 327/541 |
| 6,522,111 | B2 * | 2/2003 | Zadeh et al. | 323/277 |
| 6,559,689 | B1 * | 5/2003 | Clark | 327/97 |
| 6,600,299 | B2 * | 7/2003 | Xi | 323/280 |
| 6,654,263 | B2 * | 11/2003 | Kurotsu | 363/60 |
| 6,686,728 | B2 * | 2/2004 | Nakajima | 323/281 |
| 6,690,148 | B2 * | 2/2004 | Harrison | 323/281 |
| 6,710,585 | B2 * | 3/2004 | Schmitt et al. | 323/281 |
| 6,812,678 | B1 * | 11/2004 | Brohlin | 323/280 |
| 7,042,281 | B2 * | 5/2006 | Baglin et al. | 327/541 |
| 7,068,094 | B1 * | 6/2006 | Jamal et al. | 327/541 |
| 7,119,606 | B2 * | 10/2006 | Fahim | 327/541 |
| 7,199,565 | B1 * | 4/2007 | Demolli | 323/273 |
| 2003/0098675 | A1 * | 5/2003 | Harrison | 323/281 |
| 2003/0197543 | A1 * | 10/2003 | Imai | 327/427 |

FOREIGN PATENT DOCUMENTS

| | | | |
|---|---|---|---|
| JP | 2087818 | | 3/1990 |
| JP | 6169565 | | 6/1995 |
| WO | WO 2004/040760 | * | 5/2004 |

OTHER PUBLICATIONS

Notice of Ground of Rejection, mailed Jun. 17, 2008, 8 pgs.

* cited by examiner

-- PRIOR ART --

LINEAR REGULATOR WITH DISCHARGING GATE DRIVER

CROSS REFERENCE TO RELATED APPLICATIONS

This application is based on and hereby claims priority to Japanese Application No. 2004-205912 filed on Jul. 13, 2004 in Japan, the contents of which are hereby incorporated by reference.

BACKGROUND OF THE INVENTION (1) Field of the Invention

The present invention relates to a step-down circuit, which is mounted on, for example, semiconductor integrated circuits, for stepping down the power supply voltage.

(2) Description of Related Art

Recently, minute processing for higher density integration of LSI (Large Scale Integration) has been progressing. As the higher integration progresses, the withstand voltage of transistor decreases; and thus, it is getting difficult to increase the power supply voltage.

On the other hand, depending on the purpose, there is such a case that, due to the system power supply, the power supply voltage is high. In such a case, the power supply voltage cannot be used as it is for the operating voltage within the LSI. Accordingly, the power supply voltage is stepped down once within the LSI, and then, supplied to the interior of the LSI.

Also, there is such a case that, in order to reduce the power consumption, the operating voltage within the LSI is intentionally reduced.

For that reason, a step-down circuit, which steps down the power supply voltage, is used.

For example, as shown in FIG. 9, there is a step-down circuit, which comprises an N channel type output transistor 101, a booster 102 for raising the gate voltage thereof, a voltage dividing circuit 103 including two resistors 103A and 103B of resistance values R1 and R2, a comparator 104, a clamp circuit 105 and a reference voltage generating device 106, and the step-down circuit is connected to a load circuit 107 (refer to, for example, Gerrit W. den Besten and Bram Nauta, "Embedded 5V-to-3.3V Voltage Regulator for Supplying Digital IC's in 3.3V CMOS Technology" IEEE JOURNAL OF SOLID-STATE CIRCUITS, VOL. 33, NO. 7, JULY 1998). It is arranged so that clock signal is inputted to the booster 102 from a ring oscillator 108, and EN (enable) signal is inputted from the comparator 104.

In this step-down circuit, it is arranged so that the comparator 104 compares the divided voltage, which is the step-down output (step-down voltage) of the output transistor 101 divided by the voltage dividing circuit 103, with the reference voltage from the reference voltage generating device 106, and based on the comparison result, the operation of the booster 102 is controlled. And as shown in FIG. 10, when the output voltage (step-down output) of the step-down circuit is equal to or lower than a required voltage (target voltage), EN signal, which is outputted from the comparator 104, comes out as "H" (H level). Based on this, the booster 102 is caused to operate, and thus, the booster output, i.e., the gate voltage of the output transistor 101 is gradually raised. According to this, the step-down output also is gradually raised. On the other hand, when the output voltage of the step-down circuit becomes higher than a required voltage (target voltage), the EN signal outputted from the comparator 104 comes out as "L" (L level). Based on this, the operation of the booster 102 is stopped. After that, the booster output, i.e., the gate voltage of the output transistor 101 is maintained at a constant level, and thus, the step-down output is also maintained at a constant level. Since the step-down output is maintained at a constant level, the divided voltage, which is inputted to the inverting input terminal (−input terminal) of the comparator 104, is also maintained at a constant level.

SUMMARY OF THE INVENTION

However, for example, when a noise enters into a load circuit 107 connected to the output end of the step-down circuit from the outside, the output voltage (step-down voltage, step-down output) of the step-down circuit changes. On the other hand, since the transistor 101 has parasitic capacitance between the output side and the gate side thereof, for example, when the step-down voltage changes due to a noise from the outside, there may be a case that a coupling occurs between the output side and the gate side of the output transistor 101 and a small amount of electric charge is injected thereinto.

When such electric charge is injected, even after the step-down voltage has reached a required voltage, and the operation of the booster 102 is stopped and the gate voltage of the output transistor 101 is maintained at a constant level, as shown with broken lines in FIG. 10, the booster output, i.e., the gate voltage of the output transistor 101 rises, and accompanying this, the step-down output also rises. In this case, the divided voltage, which is inputted to the inverting input terminal (−input terminal) of the comparator 104, also rises. However, even when the divided voltage rises, since the EN signal outputted from the comparator 104 is maintained to "L" (L level) without being changed, the booster 102 is kept stopped.

Further, when the above-described injection of electric charge occurs repeatedly, as shown with broken lines in FIG. 10, the gate voltage of the output transistor 101 continues to rise. As a result, the step-down voltage also continues to rise. Therefore, there arises such a problem that the electric power consumption is increased. Furthermore, there arises another problem such that a voltage exceeding the voltage in which the load circuit operates normally is supplied resulting in an operation failure.

Still further, in the case where the load circuit 107, which is connected to the step-down circuit, has a CMOS structure, a large change is caused in the current (load current), which flows to the load circuit 107. In this case also, the same problem as the above arises.

When the power supply voltage is a low voltage (for example, 3V), since the step-down voltage hardly reaches to a required voltage (expected value), the booster 102 continues to operate. As a result, there may be a case that the gate voltage of the output transistor 101 rises too much resulting in a breakdown. Accordingly, in order to prevent the gate voltage from rising to a level that the output transistor 101 may be broken down (for example, in the case of thick film transistor, approximately 6V), the clamp circuit 105 is provided. However, the clamp circuit 105 cannot prevent the voltage from rising abnormally due to the injection of electric charge as described above.

In this case, as described above, when the step-down circuit is configured using an N channel type transistor 101 as the output transistor so as to raise the gate voltage by the booster 102, in the case where the step-down voltage is equal to or lower than a target voltage, a feedback control to raise the step-down voltage using the booster 102 is possible. However, since the booster 102 has only the function to raise the voltage only, when the step-down voltage rises exceeding the target voltage, such feedback control to lower the voltage is impossible.

Accordingly, in the step-down circuit, which has the configuration as described above, for example, even when an injection of electric charge occurs due to a noise from the outside causing the step-down voltage to rise, it is not possible to cope with the problem.

The present invention has been proposed in view of the above problems. An object of the present invention is accordingly to provide a step-down circuit, which is, even when the output transistor is injected with electric charge due to an external causes such as, for example, noise from the outside, capable of preventing the step-down voltage from rising.

For this reason, a step-down circuit according to the present invention comprises an N channel type output transistor of which voltage at a control end thereof is controlled so as to step down a power supply voltage inputted from an input end thereof to a desired voltage and output the step-down voltage from an output end thereof;

a booster, connected to the control end of the output transistor, for raising the voltage of the control end; and a discharge circuit for discharging the electric charge at the control end of the output transistor.

A semiconductor integrated circuit according to the present invention comprises the above-described step-down circuit.

Consequently, by the step-down circuit of the present invention, the following advantage is provided. That is, even when the output transistor is injected with electric charge due to external causes such as, a noise from the outside, when the output voltage (step-down voltage) of the step-down circuit gets higher, since the output voltage is discharged. Thus, the step-down voltage (step-down output) is prevented from rising. As a result, the electric power consumption can be prevented from increasing resulting in low electric power consumption. Further, a voltage exceeding the voltage in which the load circuit operates normally can be prevented from being supplied. Thus, operation failure can be prevented resulting in a high reliability.

DESCRIPTION OF THE PREFERRED EMBODIMENTS

Figure 1:
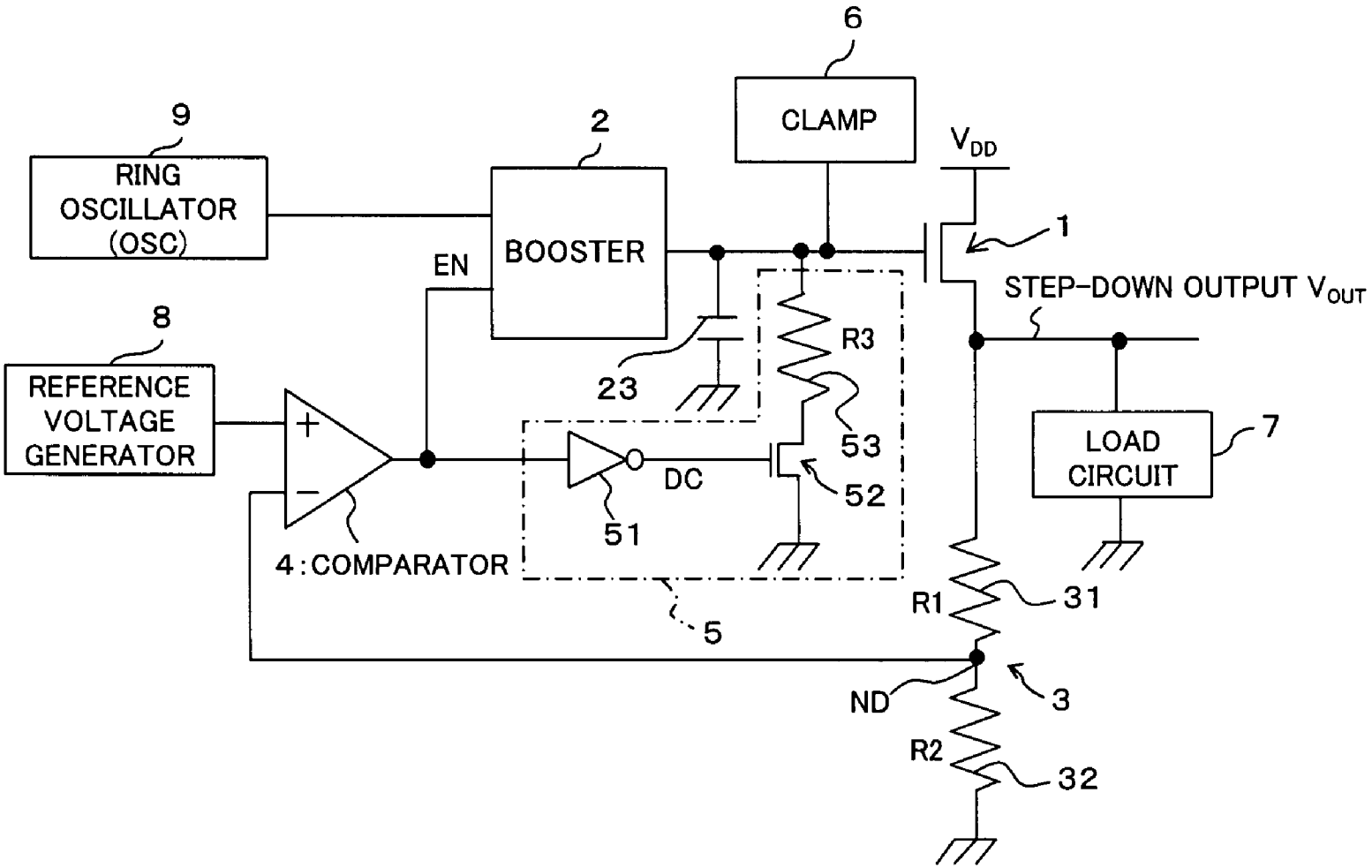
FIG. 1 is a diagram showing a configuration of a step-down circuit according to a first embodiment of the present invention.

Hereinafter, referring to the drawings, a step-down circuit according to embodiments of the present invention will be described.

First Embodiment

Figure 3:
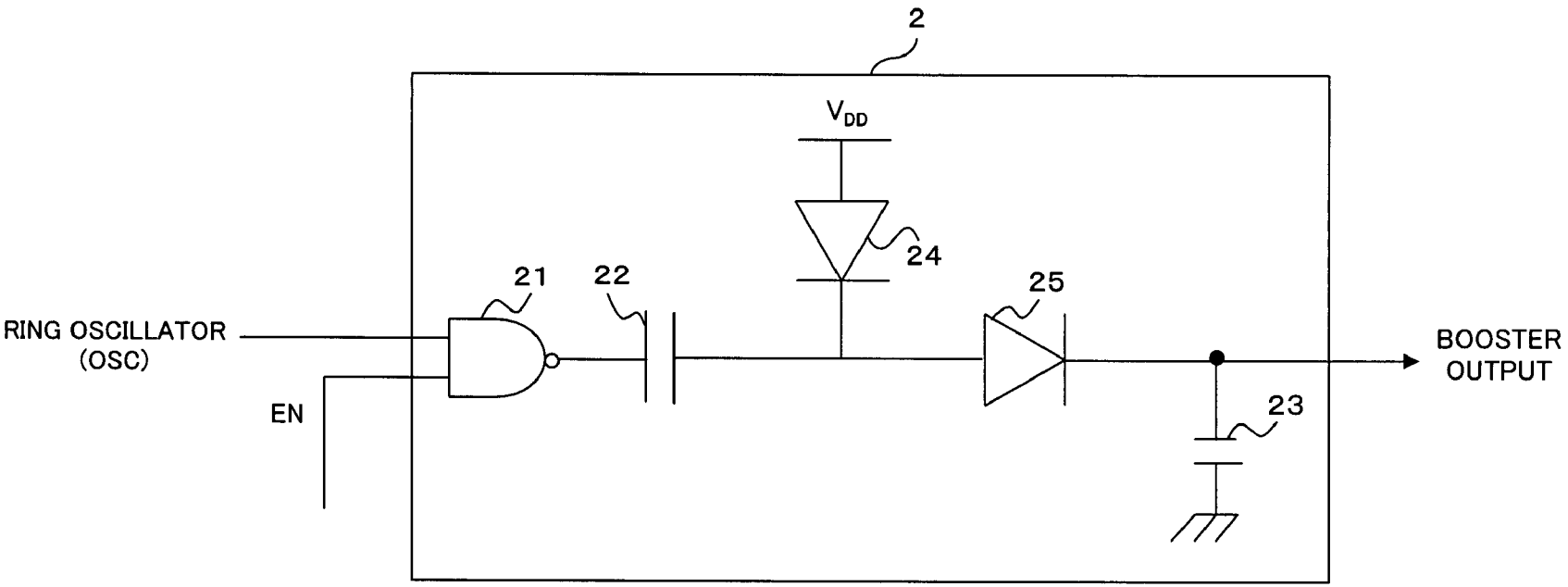
FIG. 3 is a diagram showing a configuration of a booster included in the step-down circuit according to the first embodiment of the present invention.

First of all, referring to FIG. 1 and FIG. 3, the configuration of a step-down circuit according to a first embodiment of the present invention will be described. The step-down circuit according to the embodiment is mounted on, for example, a semiconductor integrated circuit, which steps inputted power supply voltage down to a predetermined step-down voltage to output it to a load circuit. As shown in FIG. 1, the step-down circuit comprises an N channel type (Nch) transistor (output transistor; for example, nMOSFET) 1, a booster 2, a voltage dividing circuit 3 including two resistors 31 and 32 with resistance value R1 and R2 respectively, a comparator 4, a discharge circuit and a clamp circuit 6.

In this embodiment, taking the stability into consideration, as for the output transistors, not a P channel type transistor but an N channel type transistor is employed.

Here, a drain (input end) of the output transistor 1 is connected to the power supply line of the power supply voltage $V_{DD}$, a source (output end) thereof is connected to a load circuit 7, and a gate (control end) thereof is connected to a control circuit (feed back control circuit; control section) including the voltage dividing circuit 3, the comparator 4, the booster 2, and the discharge circuit 5.

It is adapted so that the power supply voltage $V_{DD}$, which is inputted to the input end of the output transistor 1, is stepped down based on the voltage (gate voltage) of the control end thereof, which is controlled by the control circuit, and is outputted from the output end thereof to the load circuit 7 as a predetermined step-down voltage (step-down output) $V_{OUT}$.

In this embodiment, it is adapted so that, when the step-down voltage $V_{OUT}$, which is outputted from the output end of the output transistor 1, decreases lower than a target voltage, the raising side feed back control circuit, which includes the voltage dividing circuit 3, the comparator 4, a reference voltage generating device 8 and the booster 2, performs the feedback control to raise the step-down voltage $V_{OUT}$; on the other hand, when the step-down voltage $V_{OUT}$, which is outputted from the output end of the output transistor 1, rises higher than the target voltage, the lowering side feed back control circuit, which includes the voltage dividing circuit 3, the comparator 4, the reference voltage generating device 8 and the discharge circuit 5, performs the feedback control to lower the step-down voltage $V_{OUT}$.

Here, the control circuit is connected to the gate (control end) and the source (output end) of the output transistor 1. And it is adapted so that the gate voltage of the output transistor 1 is raised based on the comparison result of the comparator 4.

Hereinafter, the embodiment will be described more particularly.

As shown in FIG. 1, the voltage dividing circuit 3 is connected to the output end of the output transistor 1. The voltage dividing circuit 3 is adapted so as to divide the step-down voltage $V_{OUT}$, which is outputted from the output end of the output transistor 1, and output the divided voltage from a node ND that is the output end thereof.

As shown in FIG. 1, the noninverting input terminal (+input terminal) of the comparator 4 is connected to the reference voltage generating device 8 and is adapted so that the reference voltage is inputted from the reference voltage generating device 8 to the comparator 4. Further, the inverting input terminal (−input terminal) of the comparator 4 is connected to the node ND, which is the output end of the voltage dividing circuit 3, so that the divided voltage is inputted from the voltage dividing circuit 3 to the comparator 4. On the other hand, the output terminal of the comparator 4 is connected to one of the input ends of the booster 2. The comparator 4 is adapted so as to compare the divided voltage and the reference voltage, and output the comparison result to one of the input ends of the booster 2 as EN signal (enable signal, control signal). Owing to this arrangement, the operation of the booster 2 is controlled based on the output of the comparator 4.

In this embodiment, it is adapted so that, when the divided voltage, which is inputted to the inverting input terminal (−input terminal) of the comparator 4, is equal to or lower than the reference voltage, which is inputted to the noninverting input terminal (+input terminal) of the comparator 4, the EN signal, which is outputted as the comparison result of the comparator 4, comes out as "H" (H level; high voltage potential; power supply voltage $V_{DD}$). And the EN signal is given to one of the input ends of the booster 2, and based on the EN signal (i.e., based on the output of the comparator 4), the booster 2 raises the voltage.

On the other hand, when the step-down voltage (step-down output) $V_{OUT}$, which is output from the output transistor 1, rises and the divided voltage, which is inputted to the inverting input terminal (−input terminal) of the comparator 4 is higher than the reference voltage, which is inputted to the noninverting input terminal (+input terminal) of the comparator 4, the EN signal, which is outputted as the comparison result of the comparator 4, comes out as "L" (L level; low voltage potential; grounding voltage). The EN signal is given to one of the input ends of the booster 2, and based on the EN signal (i.e., based on the output of the comparator 4), the booster 2 stops the operation. Thus, the raising of the voltage by the booster 2 is stopped.

To the other input end of the booster 2, as shown in FIG. 1, a ring oscillator (ring OSC) 9, which generates clock signals, is connected so that clock signals are inputted to the booster 2 from the ring oscillator 9. On the other hand, the output end of the booster 2 is connected to the gate of the output transistor 1 so that the raised voltage (booster output voltage) $V_{BT}$ outputted from the booster 2 is supplied to the gate of the output transistor 1. That is to say, the gate voltage $V_G$ of the output transistor 1 is raised by the booster 2 ($V_{BT}=V_G$).

The reason why the booster 2 is provided as described above to raise the gate voltage $V_G$ of the output transistor 1 is as described below. That is, in the case where an N channel type transistor is used as the output transistor 1, satisfactory step-down output cannot be obtained by providing the power supply voltage $V_{DD}$ only as the gate voltage $V_G$.

Here, the booster 2 is configured as a charge pump. As shown in FIG. 3, the booster 2 comprises, for example, a NAND circuit 21 having two input terminals, capacitors (condensers) 22 and 23 and diodes 24 and 25. When an "H" (H level) signal is inputted to the NAND circuit 21 as the EN signal from the comparator 4, corresponding to the clock signal, the "L" (L level) signal and the "H" (H level) signal are repeatedly outputted from the NAND circuit 21. Owing to this arrangement, the voltage at the both ends of the capacitor 22 changes repeatedly. As a result, electric charge is injected into the capacitor 23, and the output voltage $V_{BT}$ (i.e., the gate voltage $V_G$ of the output transistor 1) of the booster 2 is raised. The configuration of the booster 2 is not limited to the above. In FIG. 1, although the capacitor 23 is shown outside the booster 2, it is for the convenience of description of the discharge speed, which will be described later.

The discharge circuit 5 has a function to discharge the electric charge at the control end (gate) of the output transistor 1, and is configured including an inverter 51, an N channel type (Nch) transistor (switching transistor; for example, nMOSFET) 52 as the discharge transistor and a resistor 53 of resistance value R3.

Here, one end of the discharge circuit 5 is connected to the output end of the comparator 4, and the other end thereof is connected to the output end of the booster 2 (i.e., the gate of the output transistor 1). It is arranged so that, based on the comparison result of the comparator 4, the electric charge at the gate of the output transistor 1 is discharged.

A specific description will be given below.

The input end of the inverter 51 is connected to the output end of the comparator 4 so that the comparison result of the comparator 4 is inputted. On the other hand, the output end of the inverter 51 is connected to the gate (control end) of the discharge transistor 52 so that the output voltage (i.e., inverted signal which is the inverted output signal of the comparator 4) outputted from the inverter 51 is supplied to the gate of the discharge transistor 52 as the discharge signal (DC signal). Owing to this arrangement, the switching (ON/OFF control) of the discharge transistor 52 is carried out based on the DC signal.

In this embodiment, when the divided voltage, which is inputted to the inverting input terminal (−input terminal) of the comparator 4, is equal to or lower than the reference voltage, which is inputted to the noninverting input terminal (+input terminal) of the comparator 4, the signal, which is outputted as the comparison result of the comparator 4, comes out as "H" (H level; power supply voltage). However, the signal is inverted by the inverter 51, and the DC signal comes out as "L" (L level), and the discharge transistor 52 turns to OFF. In this case, the discharge circuit 5 does not operate, and accordingly, the electric charge at the gate of the output transistor 1 is not discharged.

On the other hand, when the step-down voltage (step-down output) $V_{OUT}$, which is outputted from the output transistor 1, becomes high and when the divided voltage, which is inputted to the inverting input terminal (−input terminal) of the comparator 4, is equal to or higher than the reference voltage, which is inputted to the noninverting input terminal (+input terminal) of the comparator 4, the signal, which is outputted as the comparison result of the comparator 4 comes out as "L" (L level). However the signal is inverted by the inverter 51. The DC signal comes out as "H" (H level), and the discharge transistor 52 turns ON accordingly. Owing to this, the discharge circuit 5 operates, and thus, the electric charge (booster output) at the gate of the output transistor 1 is discharged.

In this embodiment, taking the ON resistance $R_{on}$ of the discharge transistor 52 into consideration, to eliminate the influence thereof, the resistor (discharging resistor) 53 of resistance value R3 is provided in series with the discharge transistor 52. That is, the drain (input end) of the discharge transistor 52 is connected to the output end of the booster 2

(i.e., the gate of the output transistor 1) being interposed by the resistor 53. The source (output end) of the discharge transistor 52 is grounded.

Here, a description about the speed of discharge will be given.

The speed of discharge depends on the capacity (additional capacity of booster output) CL of the capacitor 23, which accumulates the raised voltage $V_{BT}$ raised by the booster 2, the resistance value R3 of the discharge resistor 53 and the resistance value (ON resistance) $R_{on}$ of the discharge transistor 52 in the ON state.

That is, the time constant of the discharge (in the ideal state where no electric charge is injected from the outside), which represents the discharge speed, is obtained by the following formula:

$$\text{time constant of discharge}=CL\times(R3+R_{on})$$

The time constant of discharge is critical. Because, when the value is too large, the voltage cannot be prevented from rising due to the injection of the electric charge from the load circuit 7 side, which is driven by the step-down output. While, when the value is too small, the booster output voltage lowers faster, and accordingly, changes of the step-down output voltage become larger. Accordingly, the capacity CL of the capacitor 23, the resistance value R3 of the discharging resistor 53 and the ON resistance $R_{on}$ of the discharge transistor 52 have to be set so that the time constant of the discharge is not too large or too small.

Further, it is preferred to set the time constant so that the fluctuation is as small as possible. However, the ON resistance of the discharge transistor 52 changes depending on the manufacturing fluctuation and the temperature dependency. Also, the ON resistance changes depending on the "H" (H level; power supply voltage) of the gate voltage. Therefore, in this embodiment, in order to reduce the influence of the fluctuation factors of the time constant, the discharging resistor 53 is provided in series with the discharge transistor 52. However, the discharging resistor 53 may not be provided with the discharge transistor 52.

The clamp circuit 6 is for preventing the gate voltage of the output transistor 1 from rising exceeding a predetermined voltage. For example, the clamp circuit 6 prevents the gate voltage from rising exceeding a gate voltage in which the output transistor 1 is broken down (for example, in the case of thick film transistor, approximately 6V).

Next, referring to FIG. 2, the operation of the step-down circuit according to the embodiment will be described.

Figure 2:
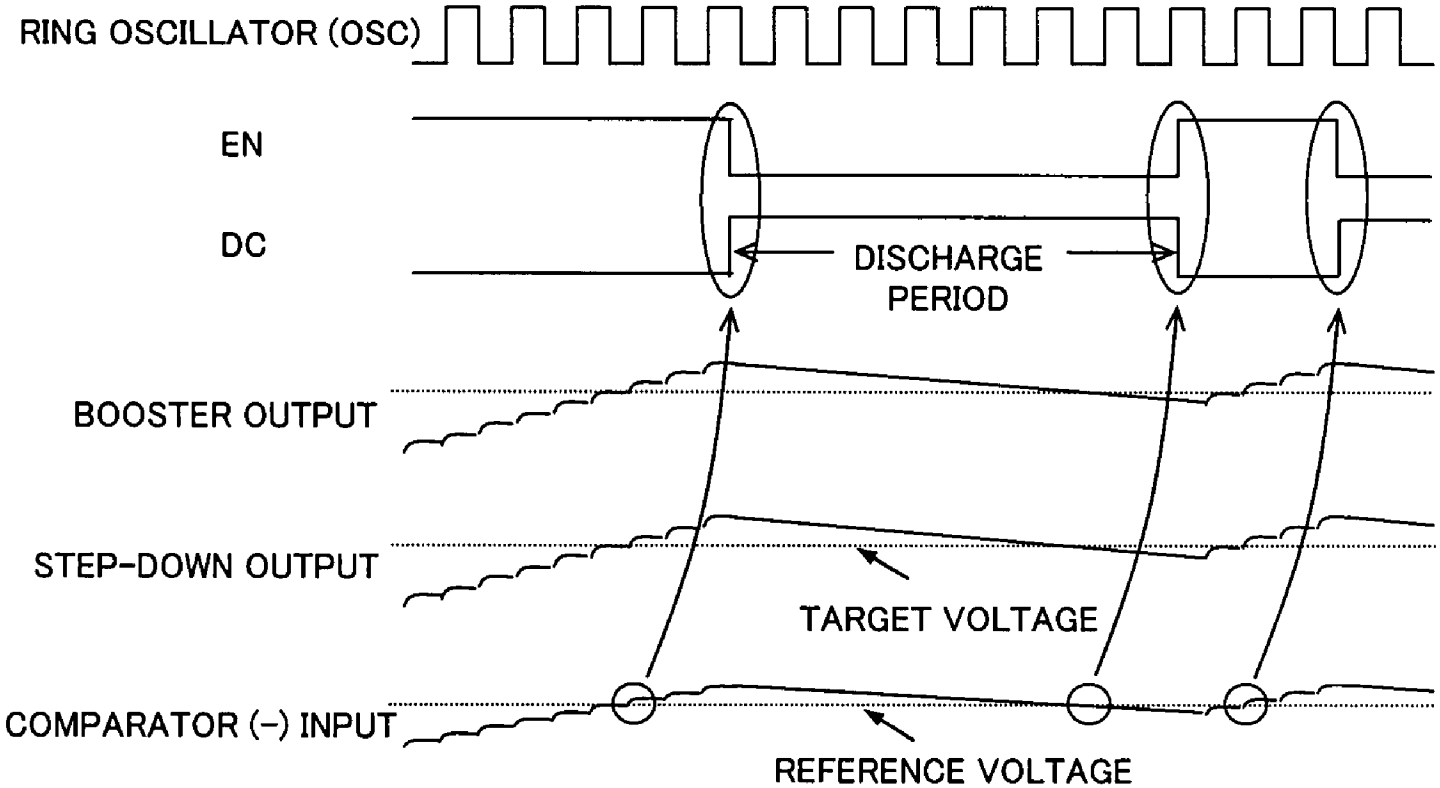
FIG. 2 is a time chart for illustrating the operation of the step-down circuit according to the first embodiment of the present invention.

First of all, as shown in FIG. 2, when the step-down voltage (step-down output) $V_{OUT}$, which is outputted from the output transistor 1, is equal to or lower than the desired voltage (target voltage), the divided voltage, which is inputted to the inverting input terminal (−input terminal) of the comparator 4, becomes equal to or lower than the reference voltage, which is inputted to the noninverting input terminal (+input terminal) of the comparator 4. Therefore, the EN signal outputted as the comparison result of the comparator 4 comes out as "H" (H level; high voltage potential; power supply voltage $V_{DD}$). As a result, the booster 2 is caused to operate, and the output voltage $V_{BT}$ (booster output; i.e., the gate voltage $V_G$ of the output transistor 1) of the booster 2 is raised.

On the other hand, since the signal, which is outputted as the comparison result of the comparator 4, is inverted by the inverter 51, the DC signal comes out as "L" (L level; low voltage; grounding voltage), the discharge transistor 52 turns to OFF. Accordingly, the discharge circuit 5 does not operate, and the electric charge of the gate of the output transistor 1 is not discharged.

After that, when the step-down voltage (step-down output) $V_{OUT}$, which is outputted from the output transistor 1, becomes higher than the required voltage, the divided voltage, which is inputted to the inverting input terminal (−input terminal) of the comparator 4, becomes higher than the reference voltage, which is inputted to the noninverting input terminal (+input terminal) of the comparator 4. Thus, the EN signal outputted as the comparison result of the comparator 4 comes out as "L" (L level). As a result, the operation of the booster 2 is stopped.

On the other hand, since the signal, which is outputted as the comparison result of the comparator 4, is inverted by the inverter 51, the DC signal comes out as "H" (H level); and thus, the discharge transistor 52 turns to ON. Owing to this, the discharge circuit 5 operates, and the discharge of the electric charge (booster output) from the gate of the output transistor 1 starts.

As described above, when the operation of the booster 2 is stopped and the discharge by the discharge circuit 5 starts, the output voltage $V_{BT}$ of the booster 2 (booster output; i.e., the gate voltage $V_G$ of the output transistor 1) gradually decreases. Accompanying this, the step-down voltage (step-down output) $V_{OUT}$ also, which is outputted from the output transistor 1, decreases. And further, the divided voltage also, which is inputted to the inverting input terminal (−input terminal) of the comparator 4 decreases.

And when the step-down voltage (step-down output) $V_{OUT}$, which is outputted from the output transistor 1, becomes equal to or lower than the required voltage, the divided voltage, which is inputted to the inverting input terminal (−input terminal) of the comparator 4, becomes equal to or lower than the reference voltage, which is inputted to the noninverting input terminal (+input terminal) of the comparator 4. Therefore, the EN signal, which is outputted as the comparison result of the comparator 4, comes out as "H" (H level; power supply voltage). As a result, the booster 2 is caused to operate and the raising of the output voltage (booster output; i.e., the gate voltage of the output transistor 1) of the booster 2 is caused to start.

On the other hand, since the signal, which is outputted as the comparison result of the comparator 4, is inverted by the inverter 51, the DC signal comes out as "L" (L level); and thus, the discharge transistor 52 turns to OFF. As a result, the operation of the discharge circuit 5 is stopped. The period of time when the discharge circuit 5 operates and the discharge is carried out is referred to as discharge period.

After that, the control as described above is repeated.

Consequently, by the step-down circuit according to this embodiment, even when, for example, electric charge is injected into the output transistor 1 due to an external cause such as noise from the outside, when the output voltage (step-down voltage) $V_{OUT}$ of the step-down circuit becomes higher, the electric charge is discharged. Accordingly, such advantage that the step-down voltage (step-down output) $V_{OUT}$ can be prevented from rising is obtained. As a result, since the electric power consumption can be prevented from increasing; and thus, the above contributes to low power consumption. Further, the voltage greater than a level where normal operation of the load circuit 7 is ensured can be prevented from being supplied. Thus, such advantage that operation failure is prevented contributing to a high reliability also obtained.

Second Embodiment

Next, the configuration of a step-down circuit according to a second embodiment of the present invention will be described with reference to FIG. 4 and FIG. 6.

Compared to the above-described first embodiment, the step-down circuit according to the second embodiment is different in the following points; i.e., the discharge transistor is a P channel type (Pch) transistor, and a level converter is connected to the gate of the P channel type transistor.

Figure 4:
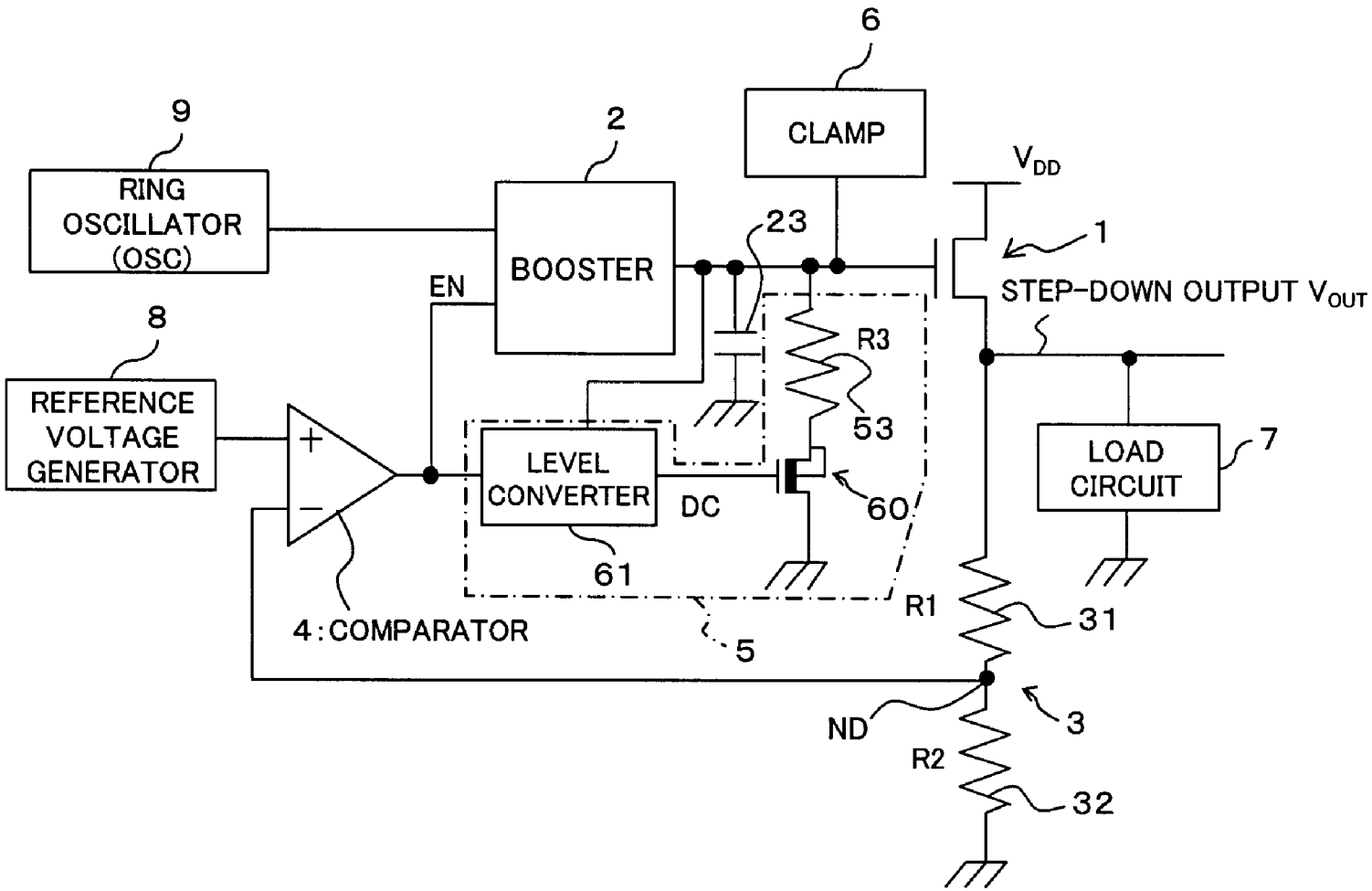
FIG. 4 is a diagram showing a configuration of a step-down circuit according to a second embodiment of the present invention.

That is, the second embodiment is configured such that, as shown in FIG. 4, the N channel type transistor as the discharge transistor in the above-described first embodiment is replaced with a P channel type transistor (switching transistor; for example, pMOSFET) 60; and the inverter is replace with a level converter [H (High) level converter] 61. In FIG. 4, the same elements as those in the above-described first embodiment will be given with the same reference numerals.

As described-above, the ON resistance of the N channel type transistor is changed by the "H" (H level; power supply voltage $V_{DD}$) of the gate voltage, and the time constant of the discharge tends to change. Here, in order to improve this point, the discharge transistor is replaced with the P channel type transistor 60. That is, the P channel type transistor 60 turns ON when the gate voltage is "L" (L level). Accordingly, the ON resistance of the P channel type transistor 60 is free from the influence of the power supply voltage. Therefore, the P channel type transistor 60 is adopted as the discharge transistor.

The P channel type transistor 60 does not turn OFF unless a gate voltage of the same potential as that of the source voltage is applied thereto. On the other hand, the source voltage of the P channel type transistor 60 as the discharge transistor becomes a voltage, which is raised by the booster 2; ordinarily, to a voltage higher than the power supply voltage $V_{DD}$. For this reason, even when the signal voltage of "H" (H level), i.e., power supply voltage $V_{DD}$ is applied thereto as the gate voltage of the P channel type transistor 60, the P channel type transistor 60 can not be turned to OFF.

In this embodiment, in order to cause the P channel type transistor 60 as the discharge transistor to turn to OFF, the level converter 61 is provided, and it is adapted so that the signal voltage of "H" (H level; power supply voltage $V_{DD}$) is shifted to the output level (boost level; boosted voltage $V_{BT}$) of the booster 2 by the level converter 61 and supplied to the gate of the P channel type transistor 60. Thus, the output voltage $V_{BT}$ of the booster 2 is supplied as the high voltage potential side level (H level) of the level converter 61.

Even when the P channel type transistor 60 is used as the discharge transistor, same as the case of the above-described first embodiment, the ON resistance changes depending on the manufacturing fluctuation and/or the temperature dependency. For this reason, in order to reduce the influence of these fluctuation factors in the time constant, the resistor 53 of resistance value R3 is provided in series with the P channel type transistor 60. In this case, when shifting the signal voltage of "H" (H level; power supply voltage $V_{DD}$) to the output level (boosted voltage $V_{BT}$) of the booster 2 with the level converter 61, the voltage drop due to the resistor 53 also has to be considered. However, the resistor 53 may not be provided.

In this embodiment, a level converter 61 is interposed before the gate of the P channel type transistor 60, i.e., between the P channel type transistor 60 and the gate comparator 4.

Figure 6:
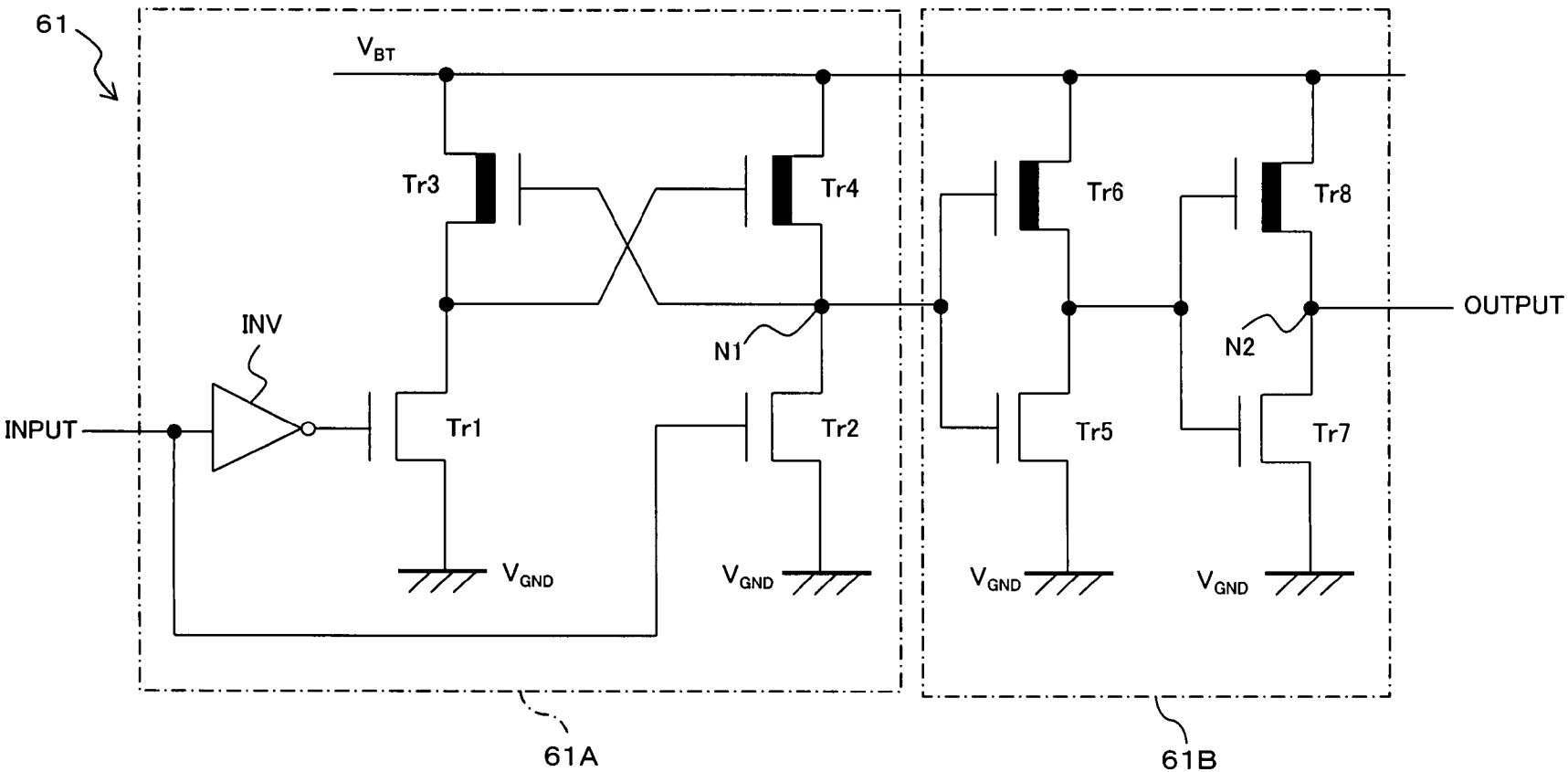
FIG. 6 is a diagram showing the configuration of a level converter included in the step-down circuit according to the second embodiment of the present invention.

For example, as shown in FIG. 6, the level converter 61 comprises a level converter circuit 61A including N channel type transistors (for example, nMOSFET) Tr1 and Tr2, P channel type transistors (for example, pMOSFET) Tr3 and Tr4 and an inverter INV, and a buffer circuit 61B including N channel type transistors (for example, nMOSFET) Tr5 and Tr7, P channel type transistors (for example, pMOSFET) Tr6 and Tr8 being connected to each other. The high voltage potential side level (H level) of the level converter 61 is the output voltage (booster output) $V_{BT}$ of the booster 2; and the low voltage potential side level (L level) is the grounding level $V_{GND}$.

When a signal outputted from the comparator 4 is inputted to the input end of the level converter 61, the signal is given to the gate of the transistor Tr2 and the inverter INV. The signal inverted by the inverter INV is given to the gate of the transistor Tr1. On the other hand, the output of the level converter circuit 61A is obtained from a node N1, which is the connection point of the transistor Tr4 and the transistor Tr2.

The output of the level converter circuit 61A is given to the buffer circuit 61B. That is, the output of the level converter circuit 61A is given to the gate of the transistors Tr5 and Tr6 constituting the buffer circuit 61B. The output from these transistors Tr5 and Tr6 is given to the transistors Tr7 and Tr8 constituting the buffer circuit 61B. And the output of the level converter 61 is obtained from a node N2, which is the connection point of the transistor Tr7 and the transistor Tr8.

For example, when the signal inputted to the level converter 61 (i.e., the output signal of the comparator 4) is high level (H level; for example, 5V), the transistor Tr1 is ON, and the gate of the transistor Tr4 is grounding level (L level). For this reason, the transistor Tr4 is also turned to ON. The transistor Tr2 is OFF. Accordingly, the output of the level converter circuit 61A becomes the high voltage potential side level (H level) i.e., the output voltage $V_{BT}$ (for example, 6V) of the booster 2. The output is outputted from the node N2 as the output of the level converter 61 via the buffer circuit 61B.

On the other hand, when the signal inputted to the level converter 61 (i.e., comparator output signal) is low level (L level), the transistor Tr2 turns to ON, and the output of the level converter circuit 61A becomes the low voltage potential side level (L level, grounding level). The output is outputted from the node N2 as the output of the level converter 61 via the buffer circuit 61B.

The configuration of the level converter 61 is not limited to the above.

In this embodiment, when the divided voltage, which is inputted to the inverting input terminal (−input terminal) of the comparator 4 is equal to or lower than the reference voltage, which inputted to the noninverting input terminal (+input terminal) of the comparator 4, the signal, which is outputted as the comparison result of the comparator 4, is resulted in "H" (H level; power supply voltage) In this case, since the signal voltage of "H" is shifted to the output level of the booster 2 (when the resistor R3 is provided, to a voltage level in which the voltage drop is taken into consideration) by the level converter 61, the DC signal becomes the output level (when the resistor R3 is provided, to voltage level in which the voltage drop is taken into consideration) of the booster 2, thus, the P channel type transistor 60 as the discharge transistor turns to OFF. In this case, the discharge circuit 5 does not operate, and thus, the electric charge of the gate of the output transistor 1 is not discharged.

On the other hand, when the step-down voltage (step-down output), which is outputted from the output transistor 1 gets higher and the divided voltage, which is inputted to the inverting input terminal (−input terminal) of the comparator 4 gets higher than the reference voltage, which is inputted to the noninverting input terminal (+input terminal) of the comparator 4, the signal outputted as the comparison result of the comparator 4 becomes "L" (L level). In this case, the level converter 61 outputs the "L" (L level) as it is. Accordingly, the DC signal becomes "L" (L level), the P channel type transistor 60 as the discharge transistor turns to ON. Owing to this, the discharge circuit 5 operates and the electric charge (booster output) of the gate of the output transistor 1 is discharged.

Since the other configuration is the same as that of the above-described first embodiment, the description thereof will be omitted.

Next, referring to FIG. 5, the operation of the step-down circuit according to the second embodiment will be described.

Figure 5:
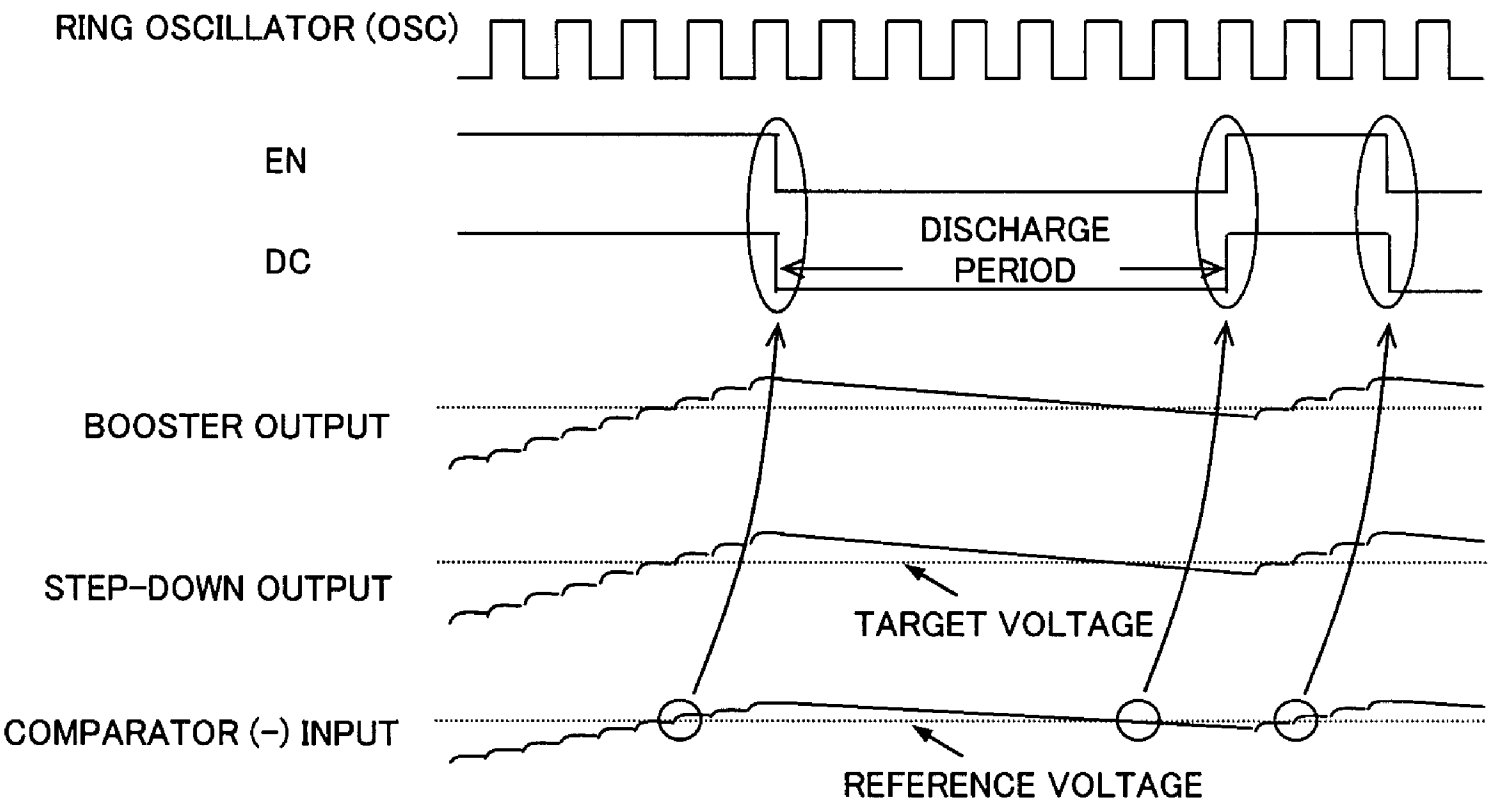
FIG. 5 is a time chart for illustrating the operation of the step-down circuit according to the second embodiment of the present invention.

Compared to the above described first embodiment, as shown in FIG. 5, the operation of the step-down circuit according to the second embodiment is different in the following point. That is, when the DC signal is "H" (H level; power supply voltage), the operation of the discharge circuit 5 is stopped, and the discharge is not carried out. And when the DC signal is "L"=(L level), the discharge circuit 5 is caused to operate, and the discharge is carried out.

Since the other operations are the same as that of the above-described first embodiment, the description thereof is omitted.

Consequently, by the step-down circuit according to the second embodiment, the same effect as that of the above-described first embodiment is obtained. Further, the P channel type transistor 60 is adopted as the discharge transistor. Accordingly, the time constant of the discharge can be adapted so as not to depend on the power supply voltage. Accordingly, such advantage that the time constant of the discharge can be prevented from changing depending on the power supply voltage.

Third Embodiment

Figure 7:
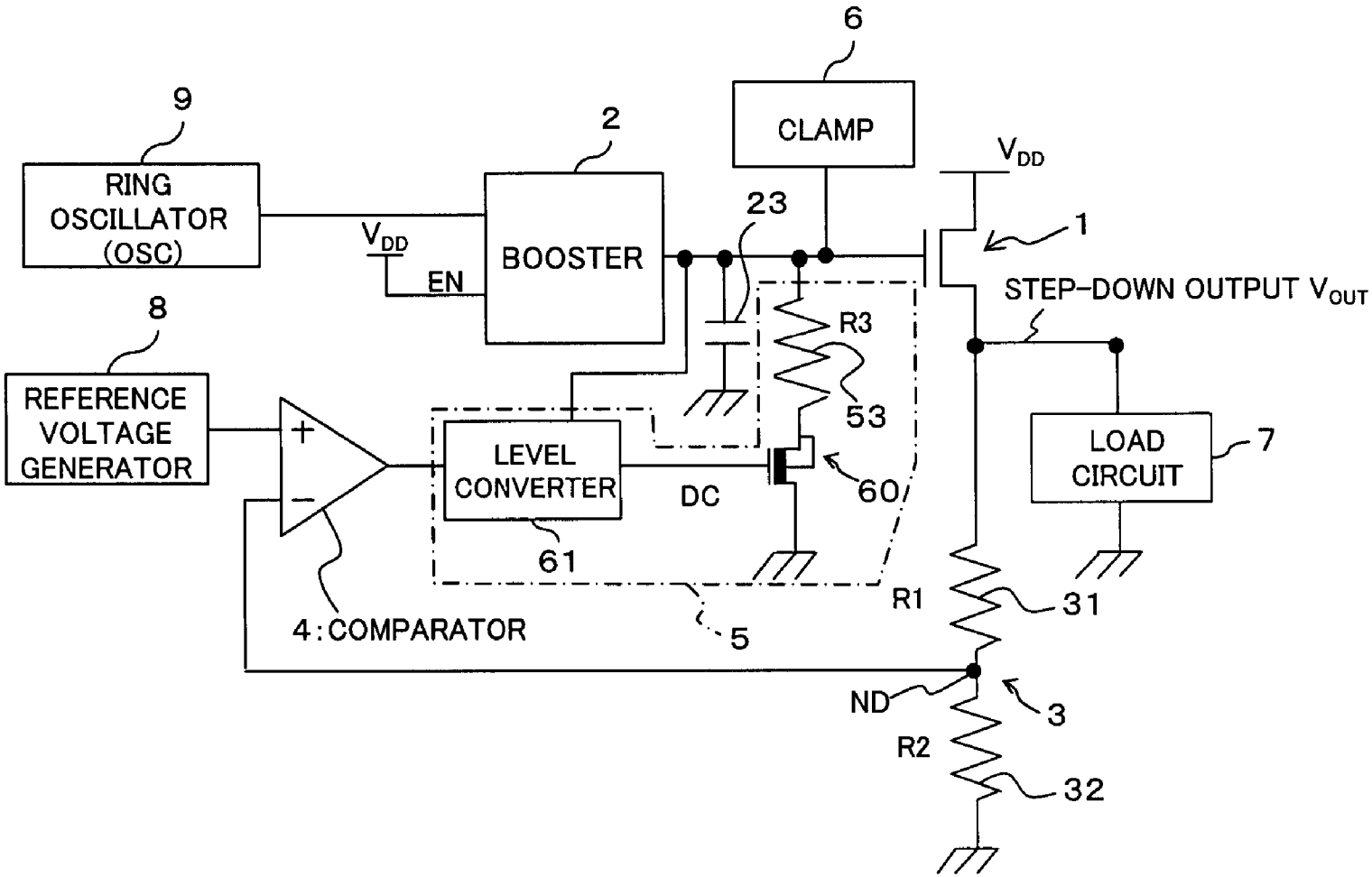
FIG. 7 is a diagram showing a configuration of a step-down circuit according to a third embodiment of the present invention.

Next, referring to FIG. 7, the configuration of a step-down circuit according to a third embodiment of the present invention will be described.

Compared to the above-described second embodiment, the step-down circuit according to the third embodiment is different therefrom in the following point. That is, the EN signal, which controls the booster 2 to operate/stop, is fixed to "H" (H level; power supply voltage $V_{DD}$) to allow the booster 2 to operate anytime. That is, in this embodiment, the input end of the booster 2 for inputting the EN signal is not connected to the output end of the comparator 4, but connected to the power supply line of the power supply voltage $V_{DD}$ so that the EN signal is at "H" (H level; power supply voltage $V_{DD}$) anytime and the booster 2 is in operation anytime.

In this case, the booster 2 is allowed to operate anytime, and the step-down voltage (step-down output) $V_{OUT}$, which is outputted from the output transistor 1, is controlled depending on the discharge.

Also, since the booster 2 operates anytime, the electric charge is supplied to the gate of the output transistor 1 anytime including the period when the discharge is carried out.

The reason why it is arranged so that the electric charge is supplied anytime including the period when the discharge is carried out is as described below. That is, not only that too large or too small time constant of discharge is not preferable, but also that, since the injection amount of the electric charge from the load circuit 7 side, which is driven by the step-down output $V_{OUT}$, changes depending on the operation frequency and size of the circuit at the load circuit 7 side, the setting of the time constant of discharge is extremely difficult.

Since the other configuration is the same as that in the above-described first embodiment, the description thereof is omitted.

Figure 8:
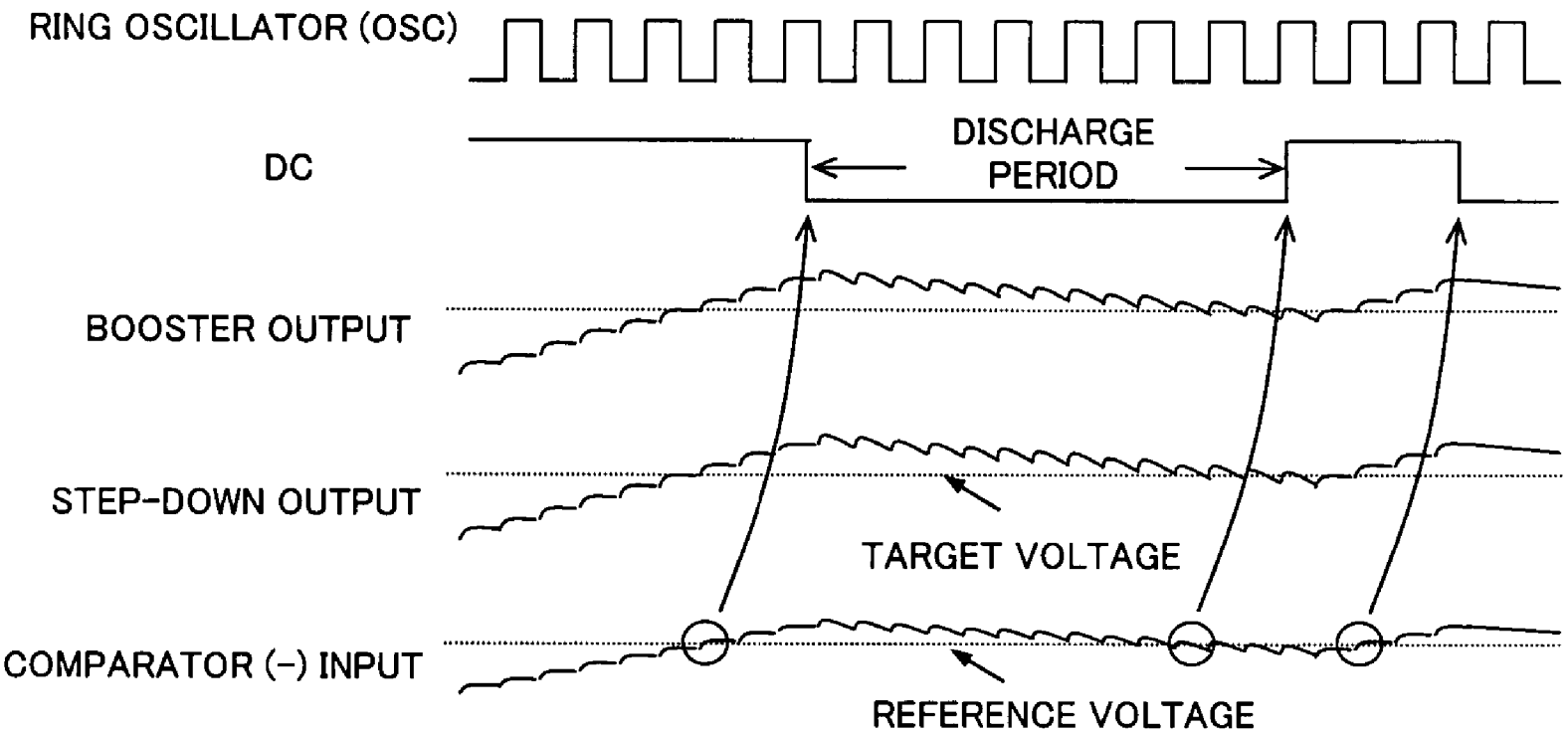
FIG. 8 is a time chart for illustrating the operation of the step-down circuit according to the third embodiment of the present invention.
Figure 9:
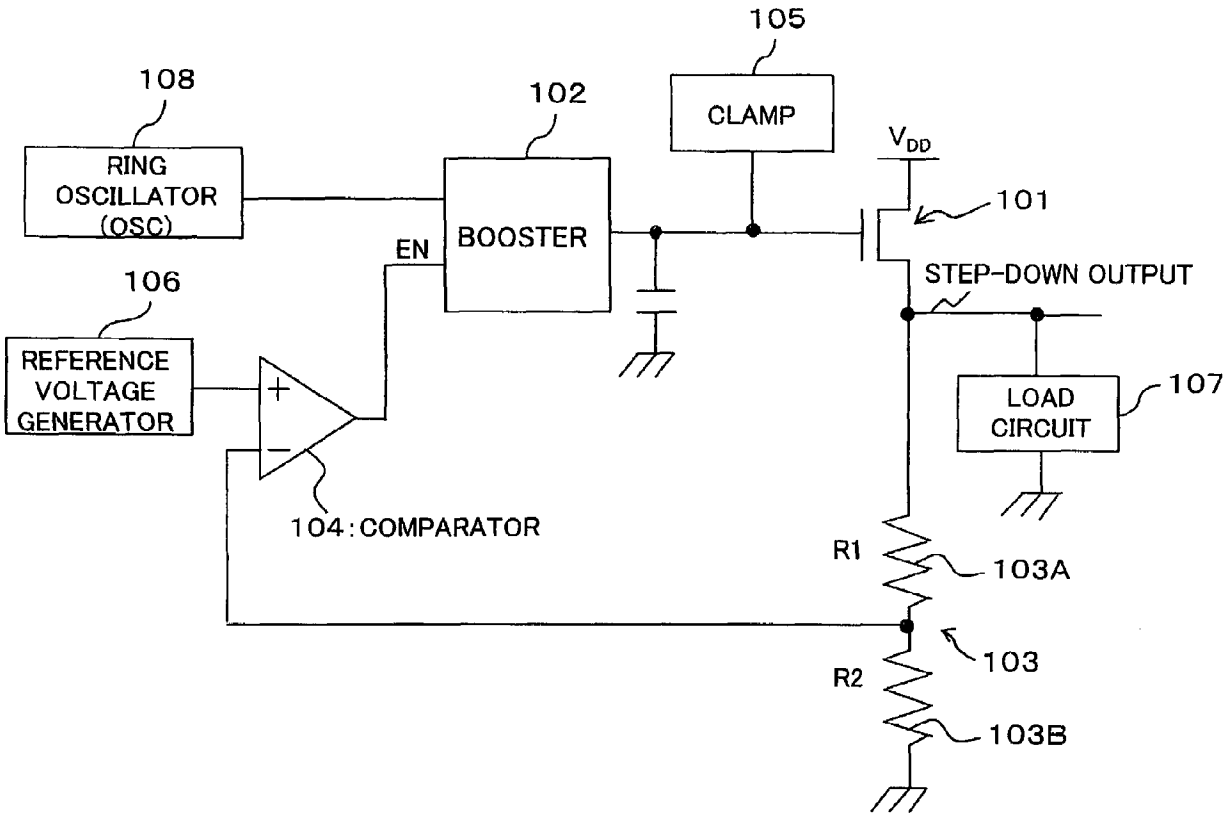
FIG. 9 is a diagram for illustrating a problem of the present invention.
Figure 10:
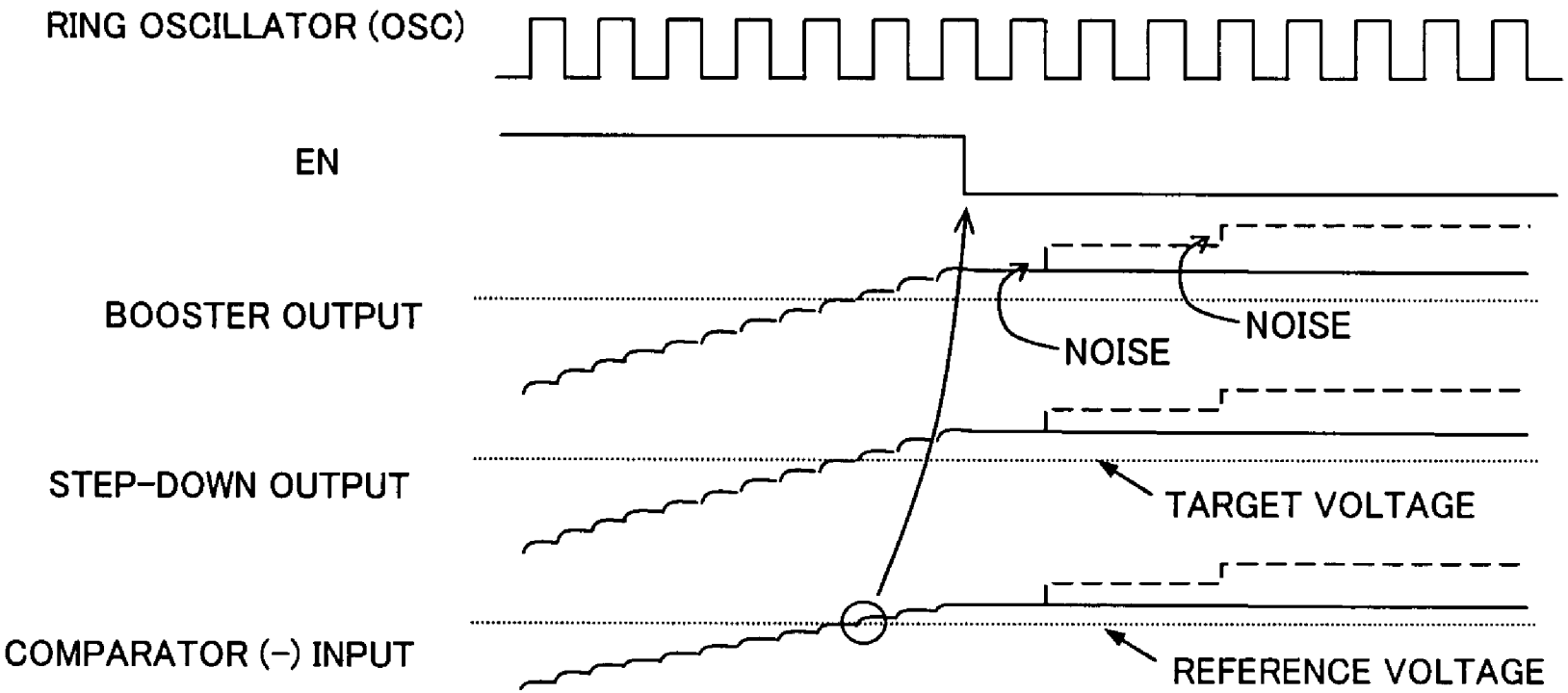
FIG. 10 is a diagram for illustrating the problem of the present invention.

Next, referring to FIG. 8, the operation of the step-down circuit according to the third embodiment will be described.

Compared to the above-described second embodiment, the operation of the step-down circuit of the third embodiment is different therefrom in the following point. That is, since the booster operates during the discharge period, the output voltage (booster output), the step-down voltage (step-down output) and the divided voltage (the voltage inputted to the −input terminal of the comparator) of the booster is fluctuates up and down. In FIG. 8, since the EN signal is at "H" (H level; power supply voltage) anytime, the EN is omitted.

When the capacity (resistance value of $R3+R_{on}$) of the discharge circuit in the third embodiment is the same as that in the above-described second embodiment, needless to say, the discharge period becomes longer. To adapt the discharge period in the third embodiment to be the same as the discharge period in the above-described second embodiment, the discharge capacity of the discharge circuit has to be adapted so as to be larger than the capacity of the discharge circuit of the above-described second embodiment. That is, when the booster is allowed to operate during the discharge period as the third embodiment, the resistance value of the resistors constituting the above-described discharge circuit and the resistance value $R_{on}$ of the ON resistance of the P channel type transistor has to be adapted to be smaller (i.e., $R3+R_{on}$ has to be smaller).

Since, the other operation is the same as that in the above described first embodiment, the description thereof is omitted.

Consequently, by the step-down circuit according to the third embodiment, the same effect as that in the above-described second embodiment can be obtained. Further, since the injection amount of the electric charge, which is charged in the capacitor 23 while the booster 2 operates, is much larger than the injection amount of the electric charge from the outside such as, for example, external noise. Therefore, by allowing the booster 2 to operate to supply the electric charge anytime including the period when the discharge is carried out, the influence due to the injection amount of the electric charge from the outside can be reduced. Accordingly, such advantage that the fluctuation of the time constant of the discharge is reduced can be obtained.

The third embodiment has been described as a modification of the above-described second embodiment. Likewise, the third embodiment can be applied to the above-described first embodiment. That is, in the circuit in the above-described first embodiment, the EN signal, which controls the booster 2 to operate/stop, may be fixed to "H" (H level; power supply voltage $V_{DD}$) to allow the booster 2 to operate anytime. That is, in place that the input end of the booster 2 for inputting the EN signal is connected to the output end of the comparator 4, the input end of the booster 2 may be connected to the power supply line of the power supply voltage $V_{DD}$ so that the EN signal is at "H" (H level; power supply voltage $V_{DD}$) anytime to allow the booster 2 in operation anytime.

What is claimed is:

1. A step-down circuit, comprising:

an N channel type output transistor of which voltage at a control end thereof is controlled so as to step down a power supply voltage inputted from an input end thereof to a desired voltage and output the step-down voltage from an output end thereof;

a charge pump circuit, connected to the control end of said output transistor, for raising the voltage of said control end;

a discharge circuit for discharging the electric charge at the control end of said output transistor, wherein the step-down voltage outputted from said output transistor decreases;

an oscillator for supplying a clock signal with constant frequency to said charge pump circuit; and a comparator for comparing a divided voltage divided from the step-down voltage outputted from the output end of said output transistor and a reference voltage;

wherein, when the step-down voltage outputted from said output transistor is higher than the desired voltage, said discharge circuit discharges the electric charge at the control end of said output transistor based on the comparison result of said comparator without stopping the operation of said charge pump circuit; and when the step-down voltage outputted from said output transistor is equal to or lower than the desired voltage, said charge pump circuit raises the voltage at the control end of said output transistor in response to the clock signal and the operation of said discharge circuit is stopped.

2. The step-down circuit according to claim 1, wherein, said discharge circuit is configured to include a resistance and a transistor.

3. The step-down circuit according to claim 2, wherein, the transistor of said discharge circuit is an N channel type transistor.

4. The step-down circuit according to claim 2, wherein, the transistor of said discharge circuit is a P channel type transistor.

5. The step-down circuit according to claim 4, wherein, said discharge circuit is connected to the control end of said P channel type transistor and includes a level converter for causing the power supply voltage level to agree with the output voltage level from said charge pump circuit.

6. A semiconductor integrated circuit, comprising a step-down circuit as set forth in claim 1.

* * * * *